US005397962A

United States Patent [19]

Moslehi

[11] Patent Number: 5,397,962

[45] Date of Patent: Mar. 14, 1995

[54] SOURCE AND METHOD FOR GENERATING HIGH-DENSITY PLASMA WITH INDUCTIVE POWER COUPLING

[75] Inventor: Mehrdad M. Moslehi, Dallas, Tex.

[73] Assignee: Texas Instruments Incorporated, Dallas, Tex.

[21] Appl. No.: 905,982

[22] Filed: Jun. 29, 1992

[51] Int. Cl.[6] ..... H05B 37/00

[52] U.S. Cl. ..... 315/111.51; 315/111.81

[58] Field of Search ..... 315/111.21, 111.51, 315/111.81; 219/121.52; 204/192.1, 298.04

[56] References Cited

U.S. PATENT DOCUMENTS

| | | | |
|---|---|---|---|
| 3,814,983 | 6/1974 | Weissfloch et al. | 315/111.21 |
| 4,496,448 | 1/1985 | Tai et al. | 204/192 |
| 4,810,935 | 3/1989 | Boswell | 315/111 |
| 4,871,421 | 10/1989 | Ogle et al. | 156/643 |
| 4,948,458 | 8/1990 | Ogle | 156/643 |
| 4,990,229 | 2/1991 | Campbell et al. | 204/298 |
| 5,091,049 | 2/1992 | Campbell et al. | 156/643 |
| 5,122,251 | 6/1992 | Campbell et al. | 204/298 |

OTHER PUBLICATIONS

Article by A. J. Perry, D. Vender, and R. W. Boswell, "The Application of the Helicon Source to Plasma Processing", J. Vac. Sci. Technol. B 9 (2), Mar./Apr., 1991, pp. 310–317.

*Primary Examiner*—Robert J. Pascal
*Assistant Examiner*—Michael B. Shingleton
*Attorney, Agent, or Firm*—Peter T. Rutkowski; Richard L. Donaldson; William E. Hiller

[57] ABSTRACT

A source and method for generating high density plasma with inductive radio-frequency power coupling is provided in which coil antenna sections (34) within a plasma source (12) are used to generate a high-density uniform plasma. This plasma is then guided into transferred in a transfer chamber (14) and then to a processing chamber (16). Within the processing chamber (16), the plasma reacts with a semiconductor wafer (18) or another workpiece for plasma-enhanced deposition or etch processing.

18 Claims, 3 Drawing Sheets

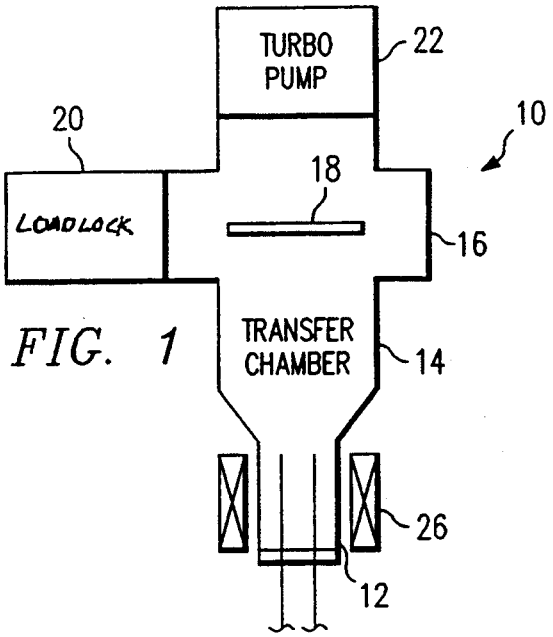
FIG. 1
FIG. 3
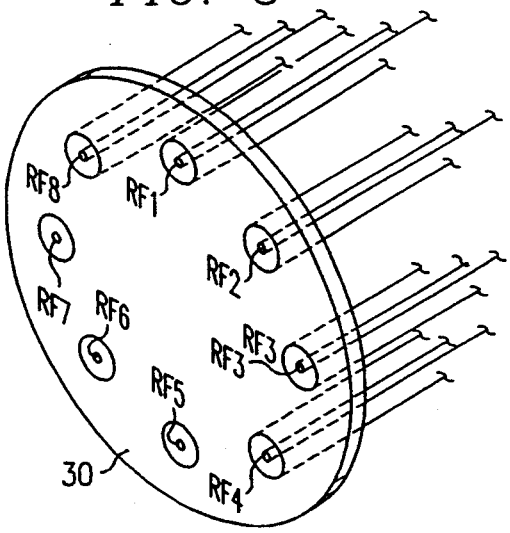
FIG. 2
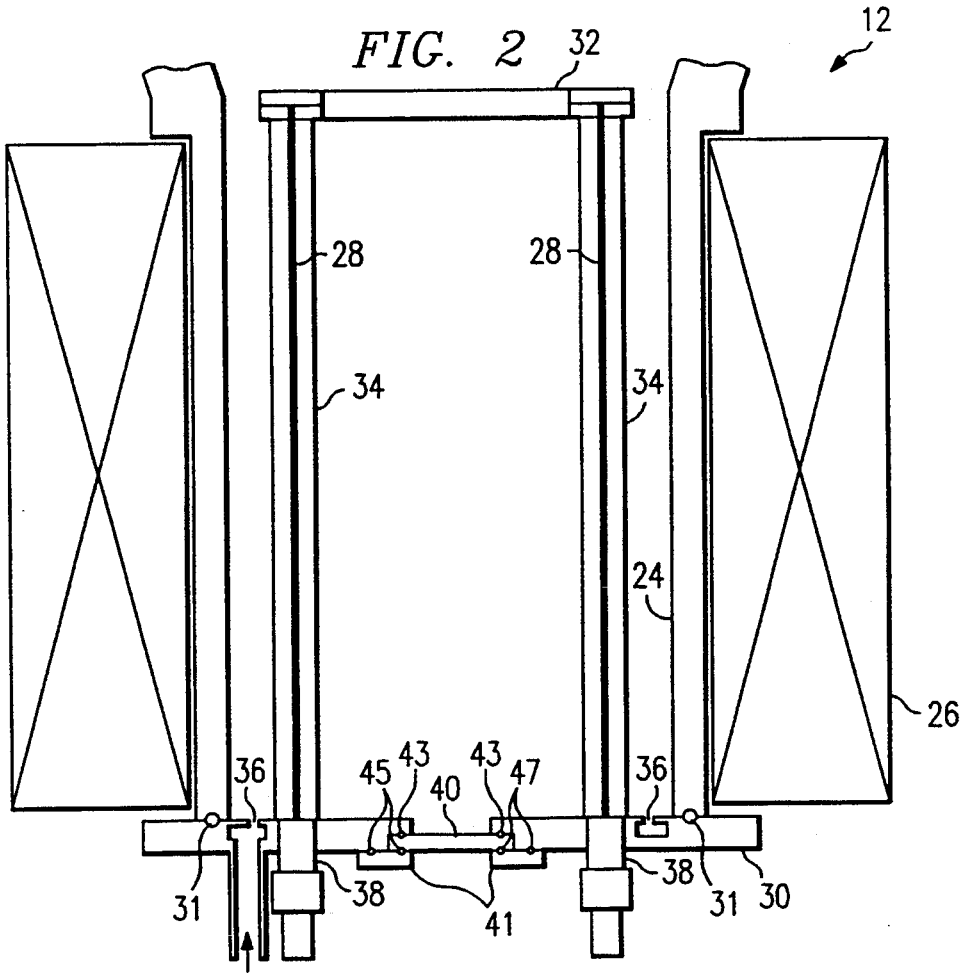

FIG. 6
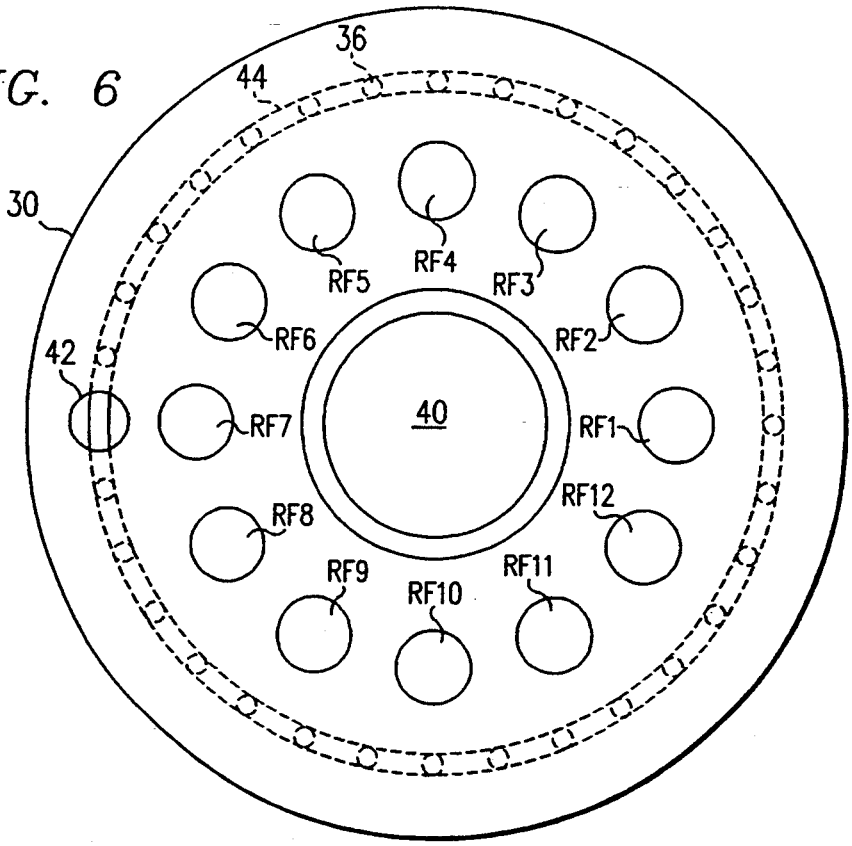
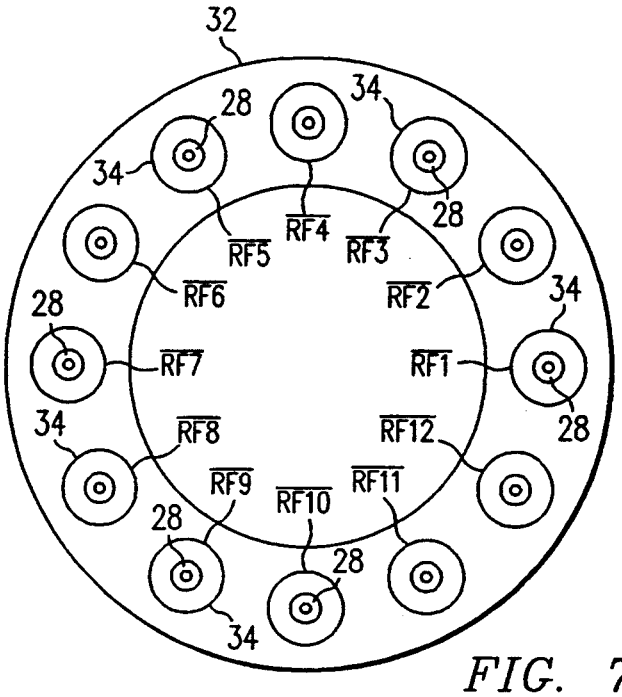
FIG. 7

SOURCE AND METHOD FOR GENERATING HIGH-DENSITY PLASMA WITH INDUCTIVE POWER COUPLING

TECHNICAL FIELD OF THE INVENTION

This invention relates generally to the field of electronic device processing, and more particularly to a source and method for generating high-density plasma with inductive power coupling for power-enhanced semiconductor device processing.

BACKGROUND OF THE INVENTION

Applications for the use of plasma are widespread, and a particular area of use is that of semiconductor device fabrication. For example, plasmas are used as dry etchants in both blanket and patterned etches. Such etches can exhibit good anisotropic and selective etching qualities, and particular plasma etches, such as reactive-ion etches, allow for etching of fine patterns with good dimensional control.

In the field of semiconductor device fabrication, plasmas are also used for material layer deposition. For example, dielectrics or conductive layers may be deposited through use of plasma-enhanced deposition. Chemical vapor deposition (CVD) can also be enhanced through the use of plasmas, for example, plasma-enhanced chemical-vapor deposition ("PECVD") processes may be used to deposit material layers such as oxides, and nitrides at low substrate temperatures. Plasmas can also be used in physical-vapor deposition or sputtering applications.

To be effective in the above-described applications, and in other applications, plasmas should have a high-density (measured as the number of electrons or ions per cubic centimeter), and should have a uniform density throughout the plasma. Furthermore, the kinetic energy of the ions should also be controlled, since, for example, excessive energy ions can cause damage to semiconductor devices with which the plasma is to react.

One type of plasma source that has been developed and commonly used is a parallel-plate plasma source. Such sources use radio-frequency (RF) power sources to generate the plasma through gas discharge. These power sources may be 13.56 MHz or may generate another frequency. Parallel-plate plasma sources, however, typically generate plasmas having densities of less than $10^9$ $cm^3$, which is a relatively low density. Moreover, these plasma sources do not allow independent control of the plasma density and ion energies.

Another type of plasma source, the electron cyclotron resonance ("ECR") source, uses microwave (2.45 GHz) energy sources to generate plasmas having relatively high densities, on the order of over $10^{11}$ $cm^3$. Although ECR sources provide good plasma density and provide for good control of ion energy, they require low pressures to operate (on the order of 0.1 to a few milliTorr). Furthermore, ECR sources, because of the use of microwave components and the required low pressure operation, are complex and expensive. In addition, difficulties arise in generating uniform plasmas over large wafer areas.

A third type of plasma source, known as an inductive coupling plasma source, uses an inductively coupled radio-frequency source to generate the plasma. This type of plasma source provides for a relatively high plasma density and operates with a radio-frequency source (typically 13.56 MHz) and thus is less complex than ECR sources. However, plasmas generated by inductively coupled plasma sources may have significant plasma density distribution nonuniformities.

Therefore, a need has arisen for a simple plasma source that generates a relatively high density plasma of substantial uniformity for various plasma-enhanced etch and deposition applications.

SUMMARY OF THE INVENTION

In accordance with the present invention, a source and method for generating high-density plasma with inductive radio-frequency power coupling is provided which substantially eliminates or reduces disadvantages and problems associated with prior such systems. In particular, a semiconductor wafer processing system is provided in which a plasma source including a plasma formation chamber and a plurality of coil antenna sections within the plasma formation chamber is used to generate a plasma. A transfer chamber is coupled to the plasma formation chamber for transferring the plasma to a processing chamber, in which the plasma reacts with a semiconductor wafer to drive a deposition or an etch process.

An important technical advantage of the present invention is the fact that the coil antenna sections are located within the plasma formation chamber. Because of this, a high density uniform plasma can be generated with inductive power coupling.

Another important technical advantage of the present invention inheres in the fact that magnetic fields generated by the coil antenna sections can be made to rotate with respect to an axial static magnetic field, thus providing for a more uniform high-density plasmas.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 1 illustrates a block diagram of a high-density plasma source and device fabrication system constructed according to the teachings of the present invention;

FIG. 2 is a schematic side view of a high-density plasma source with inductive radio-frequency power coupling constructed according to the teachings of the present invention;

FIG. 3 is an isometric schematic of an end plate and coil antenna sections constructed according to the teachings of the present invention;

Figure 4A:
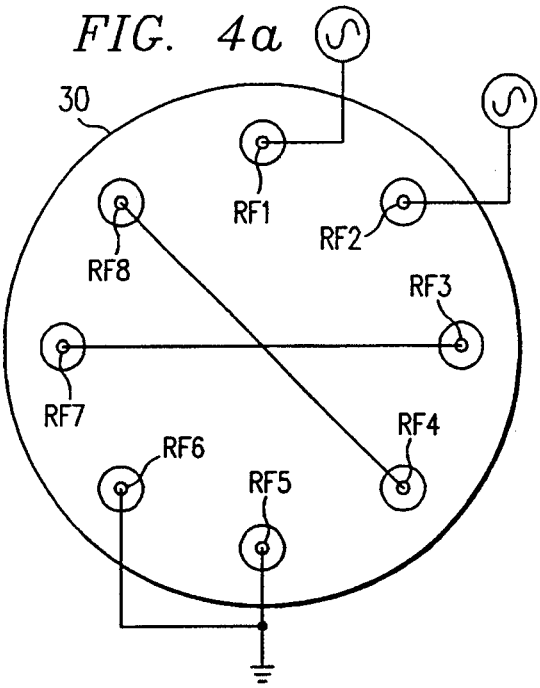

FIG. **4*a*** is a connection schematic of an end plate having 8 RF feedthroughs constructed according to the teachings of the present invention;

FIG. **4*b*** is a connection schematic of a connection ring having 8 coil antenna sections constructed according to the teachings of the present invention;

FIG. **5*a*** is a connection schematic of an end plate having 12 RF feedthroughs constructed according to the teachings of the present invention;

FIG. **5*b*** is a connection schematic of a connection ring having 12 coil antenna sections constructed according to the teachings of the present invention;

FIG. 6 is a schematic diagram of an end plate connected to RF sources having 12 RF feedthroughs constructed according to the teachings of the present invention; and FIG. 7 is a schematic diagram of an end plate ring connected to RF sources, having 12 RF feedthroughs for 12 coil antenna sections constructed according to the teachings of the present invention.

DETAILED DESCRIPTION OF THE INVENTION

FIG. 1 is a block diagram of a vacuum processing system 10 comprising a plasma formation source 12. As shown in FIG. 1, plasma generated by plasma source 12 may be transferred through a transfer chamber such as a multipolar magnetic bucket 14 to a process chamber 16. Process chamber 16, for example, may be a chamber in which semiconductor wafers are processed by interaction with the plasma generated by plasma source 12. A semiconductor wafer 18 is shown within process chamber 16. Semiconductor wafer 18 may be transferred into and out of process chamber 16 through the use of an automated vacuum loadlock 20. Automated vacuum loadlock 20 allows for transfer of semiconductor wafers while maintaining vacuum within loadlock chamber 20 and processing chamber 16. A turbomolecular pump 22 maintains a low pressure within process chamber 16, transfer chamber 14, and plasma source 12, as well as providing an exhaust for spent plasma gases.

FIG. 2 is a cross-sectional schematic of plasma source 12. The plasma is generated within a plasma formation chamber 24. Plasma formation chamber 24 may be constructed of various materials, including stainless steel, aluminum, metal alloys, or various ceramics. The use of stainless steel or aluminum allows effective source cooling and can reduce reactions between the plasma and the plasma chamber 24. The use of ceramic materials will reduce dissipation of radio-frequency electromagnetic waves into the walls of the plasma chamber 24. Considerations of the particular application of the plasma source 12 will dictate which material is best suited for that application. The preferred embodiment of this invention employs a metallic chamber. It should be recognized that FIG. 2 is a cross-sectional schematic and that plasma formation chamber 24 is substantially cylindrical. The walls of the plasma formation chamber 24 may be hollow or may have channels so as to allow for coolant flow to dissipate heat generated in the plasma chamber 24. Furthermore, the inner wall of plasma chamber 24 may have a suitable plating for passivation. It may also be treated using another suitable process (e.g. oxidation or flourination) to improve chamber passivation.

The plasma chamber 24 is surrounded by a magnet 26. The magnet 26 may be a permanent magnet and/or an electromagnetic assembly and is used to produce an axial static magnetic field within the plasma formation chamber 24 for plasma confinement and for enhanced plasma ionization. According to one embodiment of the present invention, the magnetic flux density generated by the magnet 26 may be on the order of a few hundred Gauss.

A plurality of coil antenna sections 28 pass through an end plate 30 into the plasma formation chamber 24. End plate 30 may be formed as part of plasma formation chamber 24, or may be a separate piece sealed by, for example, an O-ring 31 as shown in FIG. 2. These coil antenna sections 28 are used to generate an electromagnetic field that is inductively coupled to the plasma medium. The coil antenna sections 28 are disposed concentrically within the plasma formation chamber 24, and terminate in ring 32. The coil antenna sections 28 are constructed of a conductive material such as stainless steel or aluminum. Furthermore, the coil antenna sections 28 may be hollow to allow for flow of a coolant, such as water, to remove heat from the coil section. The coil antenna sections 28 may be placed within non-reactive tubes 34 to prevent contamination of the plasma medium by the coil antenna sections 28. The non-reactive tubes 34 may be constructed of glass or a ceramic material such as quartz, sapphire, or alumina. Furthermore, the annular space between the non-reactive tubes 34 and the coil antenna sections 28 may be filled with a coolant, such as argon or helium, to dissipate heat generated by the coil antenna sections 28 and plasma medium.

The ring 32, which will be discussed in detail in connection with FIG. 7, provides a sealed termination point for the coil antenna sections 28. Within ring 32, coil antenna sections 28 are also electrically interconnected and any coolant through non-reactive tubes 34 or through coil antenna sections 28 is returned. Of course, it is possible to include the coolant return path in the coil sections as well.

In a particular embodiment, end plate 30 contains a ring of inlets or a single inlet 36 for injection of gas into the plasma chamber 24. The ring of inlets 36 are spaced concentrically about end plate 30 to allow gas to be injected uniformly into the plasma formation chamber 24. A ring of feedthroughs 38 in end plate 30 provides a concentric ring of electrical and coolant feedthroughs for the coil antenna sections 28 and any coolants flowing within the coil antenna sections 28 and the non-reactive tubes 34.

In operation, plasma is formed within plasma formation chamber 24. Gases injected through the ring of inlets 36 are ionized by the alternating electromagnetic field generated upon application of ultra high frequency ("UHF") or radio-frequency ("RF") power to the coil antenna sections 28. As will be discussed in connection with FIGS. 4*a* through 5*b*, various electromagnetic field patterns may be generated by coil antenna sections 28 for high-density and uniform plasma generation within plasma formation chamber 24. The electromagnetic fields generated by the coil antenna sections 28 are inductively coupled to the plasma gas medium. These inductively coupled fields increase the density and uniformity of the plasma generated within plasma formation chamber 24.

The plasma may be guided toward the semiconductor wafer 18 by an electric field induced between the plasma source 12 and the wafer 18. This electric field is induced by placing a DC or an AC potential on the wafer 18 and grounding the plasma formation chamber 24.

A sealed viewport 40 may be placed within end plate 30 so as to allow operators or plasma emission sensors to view the plasma within plasma formation chamber 24. As shown in FIG. 2, viewport 40 may be held in place by connectors 41, and a seal may be maintained across the viewport 40 by O-rings 43, 45, and 47. The viewport may be constructed of a suitable optical material, such as sapphire, that is relatively unreactive with the plasma to be generated and has a wide optical transmission band.

The diameter of the plasma formation chamber 24 may vary depending upon the application in which the plasma source 12 will be used. In one particular embodiment, the inside diameter of plasma formation chamber 24 may be six inches. This inside diameter is chosen such that the magnet 26 remains fairly small. Furthermore, the diameter of the plasma formation chamber 24 must be large enough such that the plasma generated will be large enough to cover the entire portion of the semiconductor wafer to be processed. For example, if an eight inch semiconductor wafer 18 is to be etched, plasma generated within plasma formation chamber 24 must have a large enough diameter (e.g. over 6 inches) so as to generate a uniform plasma capable of covering the full diameter of semiconductor wafer 18.

FIG. 3 is an isometric illustration of end plate 30 and coil antenna sections 28. The particular embodiment shown in FIG. 3 illustrates eight coil antenna sections 28, and accordingly eight feedthroughs in the ring of feedthroughs 38, indicated as $RF_1$ through $RF_8$. As can be seen in FIG. 3, the coil antenna sections 28 and the ring of feedthroughs 38 are spaced concentrically about the end plate 30. The center of each coil antenna section 28 should be far enough from the perimeter of end plate 30 so as to avoid unacceptable dissipation of the radio-frequency (RF) electromagnetic field generated by the antenna coil sections 28 into the conductive walls of the plasma formation chamber 24. At the same time, the feedthroughs should be far enough apart such that the distance between coil antenna sections that are farthest apart (the coil diameter) is large enough to generate the appropriate sized uniform plasma. In a particular embodiment, each of the feedthroughs of the ring of the feedthroughs 38 may be centered one inch from the perimeter of end plate 30. As examples of other embodiments, each of the feedthroughs may be located approximately one-half or two inches from the perimeter of endplate 30.

The magnetic fields generated by applying electromagnetic waves to the coil antenna sections will depend upon how the coil antenna sections are interconnected. FIGS. 4a through 5b provide connection schematics for various embodiments of the present invention. As shown in FIG. 4a, elements $RF_1$ through $RF_8$ represent the eight coil antenna sections 28 at end plate 30. As shown in FIG. 4a, $RF_1$ is coupled to a first electromagnetic RF power source, capable of outputting a voltage wave, for example, A sin $\omega$ T. $RF_2$ may be coupled to a second RF power source capable of outputting a voltage wave equal to A cos $\omega$ t. Furthermore, $RF_3$ is connected directly to $RF_1$, and $RF_4$ is connected directly to $RF_8$. Finally, $RF_5$ and $RF_6$ are connected to ground.

Figure 4B:
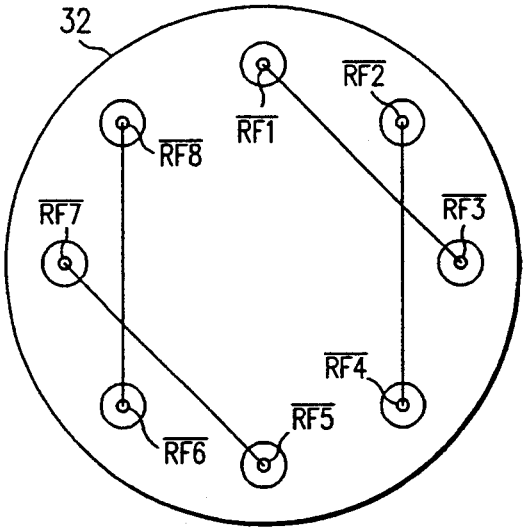

Referring now to FIG. 4b, the connection scheme at the ring 32 is illustrated for the particular embodiment discussed in FIG. 4a. As shown in FIG. 4b, the eight coil antenna sections terminate at points indicated as $\overline{RF_1}$, $\overline{RF_2}$, $\overline{RF_3}$, $\overline{RF_4}$, $\overline{RF_5}$, $\overline{RF_6}$, $\overline{RF_7}$, $\overline{RF_8}$. $\overline{RF_1}$ corresponds to the particular coil antenna section passing through end plate 30 and indicated as $RF_1$ in FIG. 4a. Likewise, each of the other points shown in FIG. 4b correspond to the particular coil antenna sections passing through end plate 30 as shown in FIG. 4a.

As discussed in connection with FIG. 2, the coil antenna sections 28 terminate within ring 32. Thus, it should be understood that the connection scheme shown in FIG. 4b is made within ring 32. Within ring 32, $\overline{RF_1}$ is connected to $\overline{RF_3}$. $\overline{RF_2}$ is connected to $\overline{RF_4}$. $\overline{RF_5}$ is connected to $\overline{RF_7}$, and $\overline{RF_6}$ is connected to $\overline{RF_8}$. Thus, the RF power coupled to the coil antenna section at point $RF_1$ passes through that coil antenna section to point $\overline{RF_1}$ at ring 32 and then to $\overline{RF_3}$, and back through the plasma chamber 24 to the end plate 30 at point $RF_3$. Since $RF_3$ is connected to $RF_7$ as shown in FIG. 4a, the electromagnetic wave continues on the coil antenna section indicated by $RF_7$ to the point $\overline{RF_7}$ in ring 32 shown in FIG. 4b. Finally, the wave travels from $\overline{RF_7}$ to $\overline{RF_5}$ FIG. 4b, back through the associated coil antenna section to $RF_5$ which is coupled to ground as shown in FIG. 4a.

Likewise, the electromagnetic RF power coupled to the coil antenna section shown as $RF_2$ in FIG. 4a propagates to $\overline{RF_2}$, and then to $\overline{RF_4}$ from $\overline{RF_2}$ through the plasma formation chamber 24 to $RF_4$, from $RF_4$ to $RF_8$, and then to $\overline{RF_8}$ from $\overline{RF_8}$ to $\overline{RF_6}$ and to ground through $RF_6$.

With these connection schemes, each of the coil antenna sections acts as a coil winding operating to generate a magnetic field within the plasma formation chamber 24. Because power sources that are 90° out of phase are coupled to $RF_1$ and $RF_2$, the magnetic field generated within the plasma chamber 24 rotates at the frequency of the RF power source. This rotating magnetic field of the particular embodiment shown in FIGS. 4a and 4b may be transverse to the axial static magnetic field generated by magnet 24. The electromagnetic field rotation causes cyclotron rotation of the electrons in the plasma and more uniform, enhanced ionization. This field rotation increases the uniformity of the plasma generated within plasma formation chamber 24.

In one particular embodiment, the magnetic field generated by the coil sections 28 will couple into a cylindrical standing helicon wave in the plasma. The standing helicon wave will rotate around the axis of plasma formation chamber 24. The wavelength of the helicon wave is proportional to $$\sqrt{\frac{B_0 a}{nf}},$$

where $B_0$ is the axial static magnetic field, n is the electron density, f is the frequency of the RF power source, and a is the coil diameter. Resonant coupling will exist when the standing helicon wavelength becomes equal to the antenna length. The antenna length is equal to the length of the coil antenna sections within plasma formation chamber 24. This resonant condition can be met by adjusting $B_0$, or the static magnetic field strength.

Figure 5A:
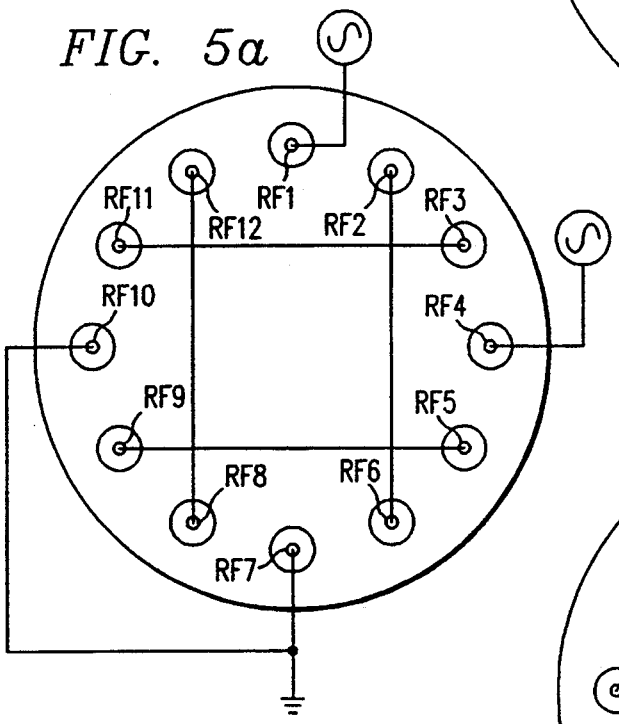
Figure 5B:
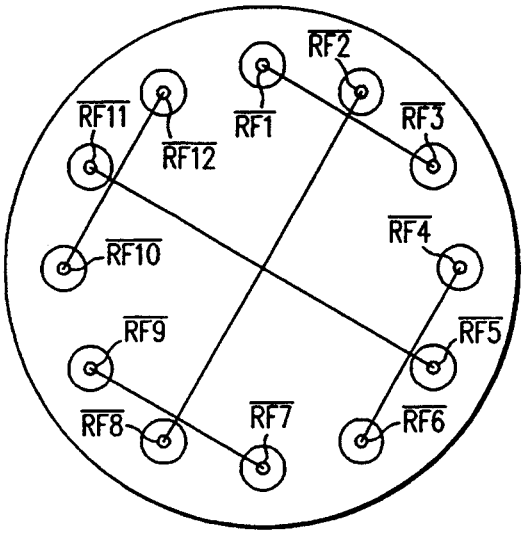

In another embodiment of the present invention, twelve coil antenna sections may be used to generate the transverse AC magnetic field. One connection scheme for such an embodiment is shown in FIGS. 5a and 5b. FIG. 5a represents the connection scheme of the end plate 30 of this particular embodiment, while FIG. 5b represents the connections within ring 32. In FIGS. 5a and 5b, $RF_1$ is coupled to an RF power source represented by A sin $\omega$ t and $\overline{RF_1}$ is coupled to $\overline{RF_3}$. $RF_3$ is coupled to $RF_{11}$ and $\overline{RF_{11}}$ is coupled to $\overline{RF_5}$. $RF_5$ is coupled to $RF_9$ and, $\overline{RF_9}$ is coupled to $\overline{RF_7}$ • $RF_7$ is coupled to ground. Furthermore, $RF_4$ is coupled to an RF power source of B cos $\omega$ t, and $\overline{RF_4}$ is coupled to $\overline{RF_6}$. $RF_6$ is coupled $RF_2$, and $\overline{RF_2}$ is coupled to $\overline{RF_8}$. $RF_8$ is coupled to $RF_{12}$, and $\overline{RF_{12}}$ is coupled to $\overline{RF_{10}}$.

$RF_{10}$ is coupled to ground.

The electromagnetic field generated by the RF power source connected to $RF_1$ will excite a transverse AC magnetic field within the plasma formation chamber 24 which is perpendicular to the $RF_5$–$RF_{11}$ diameter on the end plate 30. The magnetic field generated by the RF power source coupled to $RF_4$ will generate a transverse AC magnetic field within the plasma formation chamber which is perpendicular to the $RF_2$–$RF_8$ diameter and to the magnetic field generated by the first RF source coupled to $RF_1$. Since these magnetic fields will be 90° out of phase, the combination of the two magnetic fields will produce a rotating transverse magnetic field with a rotation frequency equal to the radio frequency source frequency.

A typical frequency for the RF power sources used to generate the electromagnetic fields in the embodiments discussed in this disclosure is 13.56 megahertz, for example. Furthermore, the magnitudes of the RF power sources used to produce electromagnetic fields in this invention may be equal or different, and typically of a magnitude capable of transferring power on the order of a few watts to kilowatts into the plasma medium.

Other connection schemes can be used without departing from the teachings of the present invention. Following are two other examples of connection schemes with regard to a twelve coil antenna section embodiment.

A first embodiment using twelve coil antenna sections results in no magnetic field rotation. In this embodiment, $RF_1$ is coupled to an RF power source, such as a represented by A sin $\omega$ t, and $\overline{RF_1}$ is coupled to $\overline{RF_2}$. $RF_2$ is coupled to $RF_{12}$, and $\overline{RF_{12}}$ is coupled to $\overline{RF_3}$. $RF_3$ is coupled to $RF_{11}$, and $\overline{RF_{11}}$ is coupled to $\overline{RF_4}$. $RF_4$ is coupled to $RF_{10}$, and $\overline{RF_{10}}$ is coupled $\overline{RF_5}$. $RF_5$ is coupled to $RF_9$, and $\overline{RF_9}$ is coupled to $\overline{RF_6}$. $RF_6$ is coupled to $RF_8$, and $\overline{RF_8}$ is coupled $\overline{RF_7}$. Finally, $RF_7$ is coupled to ground. This connection scheme will provide an AC magnetic field perpendicular to the $RF_4$–$RF_{11}$ diameter.

As another example of a connection scheme, a three phase RF connection scheme can be used to generate a rotating field having three phase components spaced 120° apart. In this scheme, $RF_1$ is coupled to an RF power source such as represented by A sin $\omega$ t and $\overline{RF_1}$ is coupled to $\overline{RF_8}$. $RF_8$ is coupled to $RF_2$, and $\overline{RF_2}$ is coupled to $\overline{RF_7}$. $RF_7$ is coupled to ground. $RF_5$ is coupled to a second RF power source represented by B sin ($\omega$ t+120°), and $\overline{RF_5}$ is coupled to $\overline{RF_{12}}$. $RF_{12}$ is coupled to $RF_6$ and $\overline{RF_6}$ is coupled to $\overline{RF_{11}}$. $RF_{11}$ is coupled to ground. $RF_9$ is coupled to a third RF power source represented by C sin ($\omega$ t+240°) and $\overline{RF_9}$ is coupled to $\overline{RF_4}$. $RF_4$ is coupled to $RF_{10}$ and $\overline{RF_{10}}$ is coupled to $\overline{RF_3}$. Finally, $RF_3$ is coupled to ground. A may equal B which may equal C. This connection scheme will result in a rotating transverse field in the plasma formation chamber 24, resulting in rotation of plasma, enhanced ionization, and improved plasma uniformity inside the plasma formation chamber 24.

It should be recognized that other connection schemes can be used without departing from the teachings of the present invention. Furthermore, it should be recognized that the number of coil sections discussed in this disclosure are for purposes of teaching the present invention only, and other numbers of antenna coil sections may be used without departing from the intended scope of the present invention.

FIG. 6 is a schematic diagram of the end plate 30 for use with a 12-coil antenna embodiment. As shown in FIG. 6, 12 RF feedthroughs are provided in the ring of feedthroughs 38. These feedthroughs are designated as $RF_1$ through $RF_{12}$. A gas injection line 42 injects gas into the ring of inlets 36 indicated with dashed lines. The ring of inlets 36 are connected to gas injection line 42 through channel 44. It should be recognized that FIG. 6 is for purposes of teaching the present invention, and other end plates may be used without departing from the intended scope of the present invention.

FIG. 7 is a diagram of a ring 32 constructed according to the teachings of the present invention, and illustrating an embodiment using 12 coil antenna sections 28. As discussed above, the coil antenna sections 28 terminate and are electrically interconnected within ring 32. Each of the end points of the coil sections are represented generally as $\overline{RF_1}$ through $\overline{RF_{12}}$. The coil antenna sections 28 are indicated on FIG. 7 and are indicated as hollow. As described above, this hollow section can be used to transfer a coolant, such as water, to remove heat from the coil antenna sections. Furthermore, the coil antenna sections 28 are shown in FIG. 7 within nonreactive tubes 34. The annular space between the nonreactive tubes 34 and the coil antenna sections 28 may be purged with a gas to dissipate jacket heat. The ring 32 may be constructed of a nonreactive material, such as sapphire, to prevent contamination and degradation from interaction with the plasma. Furthermore, the electrical connections between the coil antenna sections 28 are made within ring 32.

In summary, a plasma source is provided in which coil antenna sections are placed within the plasma chamber. Various electromagnetic fields can be generated inductively by applying RF power sources to the coil antenna sections. These electromagnetic fields are inductively coupled to the plasma medium and generate a high-density plasma in conjunction with an axial static magnetic field generated by magnets located outside of the plasma formation chamber. These inductively coupled electromagnetic fields result in a higher density and more uniform plasma.

Although the present invention has been described in detail, it should be understood the various changes, substitutions and alterations can be made without departing from the spirit and scope of the invention as defined solely by the appended claims.

What is claimed is:

1. A high density plasma source, comprising:

a plasma formation chamber having inlets for injecting plasma gases;

a magnet disposed around said plasma formation chamber and operable to generate an axial magnetic field within said plasma formation chamber; and a plurality of coil antenna sections disposed within said plasma formation chamber operable to generate a second magnetic field, such that a plasma is generated, said second magnetic field inductively coupled to said plasma and wherein said plurality of coil antenna sections are interconected such that said second magnetic field rotates relative to said axial magnetic field and said plasma formation chamber.

2. The plasma source of claim 1, wherein said magnet comprises a permanent magnet.

3. The plasma source of claim 1, wherein said magnet comprises an electromagnet.

4. The plasma source of claim 1, wherein said plasma formation chamber is substantially cylindrical and said magnet is disposed substantially concentrically around said plasma formation chamber.

5. The plasma source of claim 1, wherein said plasma formation chamber is substantially cylindrical, and wherein said plurality of coil antenna sections are spaced apart and disposed axially within said plasma formation chamber.

6. The plasma source of claim 5, wherein said plurality of coil antenna sections are substantially equidistant from an axis of said plasma formation chamber.

7. The plasma source of claim 1, wherein said plurality of coil antenna sections are interconnected such that said second magnetic field is transverse to said axial magnetic field.

8. The plasma source of claim 1, wherein said plurality of coil antenna sections are coupled to a plurality of radio-frequency power sources having a frequency such that said second magnetic field rotates at the rate of said frequency.

9. The plasma source of claim 1, wherein said plurality of coil antenna sections are coupled to a plurality of out of phase radio-frequency power sources.

10. The plasma source of claim 1, wherein said plasma formation chamber further comprises an end plate, said end plate having a plurality of electrical feedthroughs for said plurality of coil antenna sections.

11. The plasma source of claim 1, wherein said plasma formation chamber comprises channels, said channels operable to flow a coolant to dissipate heat.

12. The plasma source of claim 1, wherein said coil antenna sections are hollow, said hollow coil antenna sections operable to flow a coolant to dissipate heat.

13. The plasma source of claim 1, wherein each of said coil antenna sections are disposed within one of a plurality of non-reactive tubes.

14. The plasma source of claim 1, wherein said coil antenna sections terminate in a connector ring disposed within said plasma formation chamber.

15. A method of generating a high-density plasma, comprising the steps of:

injecting plasma gases into a plasma formation chamber;

generating an axial magnetic field, the magnetic field having components within the plasma formation chamber; and generating a second magnetic field inductively coupled to the high-density plasma, the second magnetic field generated within the plasma formation chamber and wherein said second magnetic field rotates with respect to said axial magnetic field.

16. A method of generating a high-density plasma, comprising the steps of:

injecting plasma gases into a plasma formation chamber;

generating an axial magnetic field, the magnetic field having components within the plasma formation chamber; and generating a second magnetic field inductively coupled to the high-density plasma, the second magnetic field generated within the plasma formation chamber wherein said second magnetic field rotates with respect to said axial magnetic field.

17. The method of claim 16, wherein the second magnetic field is transverse to the axial magnetic field.

18. The method of claim 16, and further comprising the step of cooling the plasma formation chamber with a coolant.

* * * * *